US006315639B1

(12) United States Patent
Kipp

(10) Patent No.: US 6,315,639 B1
(45) Date of Patent: Nov. 13, 2001

(54) BLASTING METHOD FOR CLEANING PIPES

(76) Inventor: Jens Werner Kipp, Klashofsiedlung 3, D-33659 Beilefeld (DE)

( * ) Notice: Subject to any disclaimer, the term of this patent is extended or adjusted under 35 U.S.C. 154(b) by 0 days.

(21) Appl. No.: 09/555,064

(22) PCT Filed: Dec. 2, 1998

(86) PCT No.: PCT/EP98/07820

§ 371 Date: May 24, 2000

§ 102(e) Date: May 24, 2000

(87) PCT Pub. No.: WO99/29470

PCT Pub. Date: Jun. 17, 1999

(30) Foreign Application Priority Data

| | | |
|---|---|---|
| Dec. 5, 1997 | (DE) | 297 21 479 U |
| Apr. 30, 1998 | (DE) | 298 07 792 U |
| Jul. 24, 1998 | (DE) | 298 13 172 U |

(51) Int. Cl.[7] ..... B24B 1/00
(52) U.S. Cl. ..... 451/38; 451/76; 451/102
(58) Field of Search ..... 451/38, 76, 39, 451/40, 102, 90

(56) References Cited

U.S. PATENT DOCUMENTS

| | | | | |
|---|---|---|---|---|
| 4,800,104 | * | 1/1989 | Cruickshank | 451/76 |
| 4,815,241 | * | 3/1989 | Woodson | 451/60 |
| 4,817,342 | * | 4/1989 | Martin et al. | 451/40 |
| 4,922,664 | * | 5/1990 | Spinks et al. | 451/40 |
| 5,160,548 | * | 11/1992 | Boisture | 451/36 |
| 5,375,378 | * | 12/1994 | Rooney | 451/38 |
| 5,704,825 | * | 1/1998 | LeCompte | 451/38 |
| 5,779,523 | * | 7/1998 | Mesher | 451/93 |
| 5,885,133 | * | 3/1999 | Williams, Jr. | 451/40 |

* cited by examiner

*Primary Examiner*—Eileen P. Morgan
*Assistant Examiner*—Hadi Shakeri
(74) *Attorney, Agent, or Firm*—Rothwell, Figg, Ernst & Manbeck

(57) ABSTRACT

A method and apparatus for cleaning pipes with the aid of a blasting medium in which a deflecting member surrounding a nozzle is blown through a pipe by the blasting medium blowing through the nozzle. The movement of the deflecting member and nozzle can be controlled with either a draw-rope from the upstream end of the pipe or a rod from the downstream end. Dry ice, sugar, or chemical agents may be added to the blasting medium as an blasting means.

9 Claims, 4 Drawing Sheets

BLASTING METHOD FOR CLEANING PIPES

BACKGROUND OF THE INVENTION

1. Field of the Invention

The invention relates to a blasting method for cleaning pipes, and to a device which is suitable for carrying out this method.

2. Description of the Related Art

Blasting devices are generally used to clean surfaces with the aid of a mostly gaseous blasting medium to which an abrasive blasting means such as sand or the like can be added. It is also known to use dry ice or dry snow as blasting means (DE-A-195 35 557). The use of dry ice has the advantage that the materials to be cleaned off and subsequently disposed of are not increased by additional blasting means, since dry ice evaporates after use.

The dry ice exerts a cleaning effect through:

1. Thermal shock-induced embrittlement of the material to be cleaned off, accompanied by crack formation (thermal stresses).

2. Penetration of particles into the cracks, produced by thermal stresses, in the materials to be cleaned off, followed by a sudden increase in the volume of the particles during the transition to the gaseous state (sublimation), which leads to 'blasting off' the materials to be cleaned off.

3. Kinetic energy when the particles strike the materials to be cleaned off at high speed.

With regard to quick and economic cleaning of relatively large surfaces, it is desirable for the jet produced by the blasting nozzle to be as widely fanned out as possible. Known for this purpose are flat nozzles which produce a jet widened in a fan-like fashion. However, there is still a disadvantage in using abrasive blasting means in that the particles of the blasting means impinge on the tapering walls of the nozzle, with the result that either there is an increased wear at the nozzle or, in the case of dry ice, the particles of the blasting means are smashed into finer particles which no longer have any appreciable abrasive effect.

U.S. Pat. No. 5,664,992 discloses a blasting method in which the blasting nozzle is at first tapered and then expands again, so that an acceleration of the blasting medium is achieved. A spindle-shaped deflecting member is moved through the pipe together with the blasting nozzle and deflects the abrasive blasting means onto the pipe wall.

SUMMARY OF THE INVENTION

It is the object of the invention to create a blasting method and a blasting device which permit efficient and thorough cleaning of the inner surfaces of pipes or other hollow bodies, in particular by using dry ice.

This object is achieved by means of the features specified in the independent patent claims. Advantageous refinements of the invention follow from the sub-claims.

When, as in claim 1, the deflecting member moves through the pipe alone, that is to say without the nozzle, then the movement of the deflecting member must be braked, so that its speed is always lower than the flow velocity of the blasting medium, and the desired deflecting effect is achieved. This braking action is achieved with the aid of a draw-rope or, from the opposite end of the pipe, with the aid of a rod.

The flow of the blasting medium can in this case be generated with the aid of a pressure fan or suction fan arranged at one end of the pipe to be cleaned.

The centering of the deflecting cone on the pipe axis can be achieved. either purely aerodynamically or with the aid of at least three flexible guide bars or skids which form a guide for the deflecting cone as it moves through the pipe. With regard to the ability to traverse bends, the deflecting cone can also itself be flexible. Instead of the deflecting cone, it is also optionally possible to provide, for example, a spherical deflecting member.

In the method according to claim 3 is blasting nozzle is employed which is moved through the pipe, which blasting nozzle continuously tapers to a constriction in an upstream section and expands again continuously downstream starting from the constriction, and a deflecting cone is arranged downstream of the constriction and coaxially with the blasting nozzle, as in U.S. Pat. No. 5,664,992. According to the invention, the deflecting cone is connected to the blasting nozzle via a plurality of holding webs distributed over the circumference of the blasting nozzle, with the result that the vertex of the deflecting cone is always held at a defined spacing from the constriction in the blasting nozzle. Dry ice is used as the blasting means. It is advantageous in this context that the deflecting member is suspended not in the middle, but on the circumference of the nozzle so that the pellets, which are sensitive to shocks, are not prematurely broken up.

The performance of the pressure source in terms of pressure and volume is preferably adapted to the blasting nozzle such that the blasting medium reaches the speed of sound at the constriction of the nozzle. Because of the Laval effect, the blasting medium can than accelerate to ultrasonic velocity in the downstream part of the nozzle, a particularly intensive cleaning action being achieved thereby. A stationary shockwave in the form of a Mach cone forms at the vertex of the deflecting cone. This shockwave presumably contributes to leading the blasting means away from the surface of the deflecting cone.

Inasmuch as a certain ability of the device to traverse bends is desired when cleaning pipes, the holding webs and a lance supporting the blasting nozzle can be elastically flexible.

Skids or other centering devices can be provided for centering the blasting nozzle in the pipe. If the blasting nozzle is drawn through the pipe, it is also possible to utilize aerodynamic self-centering effects for centering the blasting nozzle.

In the case of the device according to claim 8, the outside diameter of the nozzle need not itself be greater than the outside diameter of the deflecting member, with the result that a slim design is achieved which is also suitable for pipes of small inside diameter.

Since the deflection of the blasting medium and of the blasting means is effected by the deflecting member, there is a high degree of freedom of design as regards the configuration of the actual nozzle. In particular, the nozzle can be constructed as a Laval nozzle which can be used to reach high flow velocities of the blasting medium, possibly even ultrasonic flows.

The use of dry ice has so far been of little effect in cleaning materials or coatings, in the case of which the shock cooling approximately −80° C.) does not lead, or leads only to a small extent, to shock induced embrittlement of the material followed by crack formation, for example in the case of hardened deposits of lime, hard deposits of organic substances, or deposits of gypsum. Since the shock cooling does not lead here to thermal stresses or cracks, the dry ice particles cannot penetrate into the material or between the material to be cleaned and the workpiece surface, and thus also cannot lead to blasting off through sudden sublimation. The kinetic energy with which the relatively soft dry ice strikes then exhibits only a slight effect.

An improvement in the action which also permits materials which cannot be removed by dry ice alone to be cleaned away is achieved by adding to the dry ice an additional blasting means which is lightly to strongly abrasive.

The additional blasting means can be a lightly abrasive blasting means. It Is also possible, optionally, to add a strongly abrasive blasting means such as, for example, blasting granules. The addition of chemical means, for example lime-dissolving means, is likewise possible. It can also be expedient to add a cold gas, for example cooled N2 or the like, to the blasting medium in order to stabilize the dry ice pellets.

The additional blasting means are to be of such a nature/metered in such a way that they do not entail any increase in waste, or only the smallest possible increase, and cause no damage—for example by subsequent corrosion—to the surfaces to be cleaned.

It is therefore particularly advantageous to add additional blasting means which are water-soluble, are compatible with water and sewage treatment plants in the resulting small amounts of residues and do not cause any corrosive after-effects. The additional means should, in addition, be resistant to cold, and/or the abrasiveness should be further intensified by the low temperatures. On the other hand, the additional blasting means are not allowed to impair the way the dry ice works as blasting means. For example, sugar in crystalline or pulverized form is suitable.

The addition of the additional blasting means can be performed by mixing with dry ice. The mixing ratio can be selected depending on requirements.

The additional blasting means can also be (additionally) inducted by the dynamic pressure of the blasting medium (injection nozzle). This induction can be performed by a branching line in the nozzle, or also in the line feed between the dry tee feeding device and the blasting nozzle.

In the case of constrictions caused by contamination, for example, it is possible for a counterpressure of the blasting medium to occur in the blasting nozzle when pipelines are being cleaned by means of a conical nozzle or a blasting adapter attached to the pipe end. It is advantageous in this case for the additional blasting means to also be introduced under pressure into the stream of the blasting medium. The feeding of the additional blasting means can likewise be performed in this case at the blasting nozzle or the blasting adapter, or in the line feed between the dry ice feeding device and the blasting nozzle or the blasting adapter.

The pressure of the blasting medium with the aid of which the additional blasting means is fed should be the same as the pressure of the main stream, or at least so high as to avoid a build-up of the additional blasting means due to counterpressure, and to, achieve a uniform jet of the blasting media and blasting means brought together.

BRIEF DESCRIPTION OF THE DRAWINGS

Preferred exemplary embodiments are explained in more detail below with the aid of the drawing, in which.

DETAILED DESCRIPTION OF THE PREFERRED EMBODIMENTS

Figure 1:
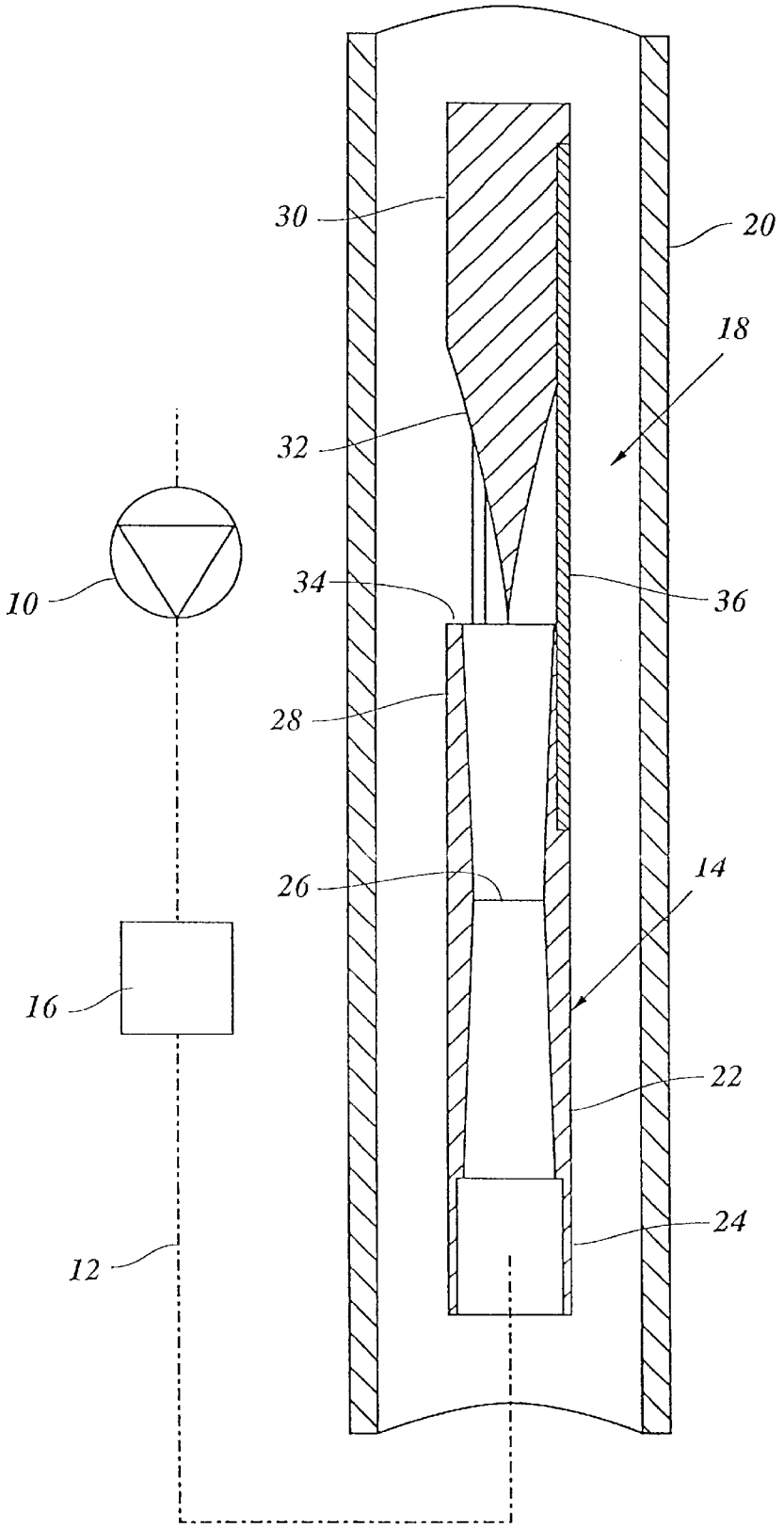
FIG. 1 shows a diagrammatic longitudinal section through a section of a pipe, and a blasting device according to the invention.

The blasting device shown in FIG. 1 has, in a way known per se, a pressure source 10, for example a compressed-air compressor, which is connected to a blasting nozzle 14 via a flexible pressure hose 12. For the purpose of metering a blasting means, for example dry ice, into the compressed air stream, a metering device 16, likewise known per se, can be-provided in the compressed air line between the compressor and the blasting nozzle.

In the example shown, the blasting nozzle 14 is part of a probe 18 which can be pulled or pushed axially through the interior of a pipe 20 to be cleaned. The blasting head can be pushed or pulled by the pressure hose 12, a lance or a draw-rope attached at the opposite end of the blasting head.

The blasting nozzle 14 is constructed as a Laval nozzle, and consequently has an upstream section 22 which continuously tapers in an approximately conical fashion to a constriction 26, starting from a coupling piece 24 for the pressure hose. Adjoining the upstream section 22 is a downstream section 28 which expands again continuously starting from the constriction 26. Because of the tapering of the upstream section 22, the flow velocity of the compressed air increases towards the constriction 26. Given adequate power of the pressure source 10 in terms of pressure and volume, the compressed air at the constriction 26 reaches the speed of sound, while the pressure there decreases to the Laval pressure. The gradual expansion of the downstream section 28 of the blasting nozzle results in the compressed air being further accelerated downstream of the constriction 26, and thus in a multiple of the speed of sound being reached.

Also belonging to the probe 18 is a deflecting cone 30 which is aligned coaxially with the blasting nozzle 14 and projects with its vertex into the gas jet emerging from the blasting nozzle. The approximately conical deflecting surface 32 of the deflecting cone 30 is rounded in a slightly concave fashion in longitudinal section in the example shown. In the example shown, the cone angle at the vertex is approximately 120.

The sections 22 and 28 of the blasting nozzle are of approximately the same length, and in the example shown the opening cross section at the mouth 34 is twice the cross section at the constriction 26.

In the embodiment shown, the vertex of the deflecting cone 30 is situated exactly at the level of the mouth 34 of the blasting nozzle 14. The vertex of the deflecting cone can optionally also project somewhat into the blasting nozzle. In this case, the cross section belonging to the deflecting cone must be taken into account when configuring the downstream section 28 of the Laval nozzle.

The ultrasonic jet emerging from the blasting 5 nozzle 14 is radially deflected in all directions by the deflecting cone 30, with the result that it takes the form of an envelope of a cone and strikes the inner wall of the pipe 20 uniformly in this form. Because of aerodynamic effects, the blasting means entrained in the gas jet is likewise deflected radially outwards, and thus develops its abrasive effect on the wall of the pipe 20, while only a negligibly small portion of the entrained particles come into contact with the deflecting cone 30.

In the exemplary embodiment according to FIG. 1, the deflecting cone 30 is held on the blasting nozzle 14 with the aid of three bars 36 arranged at angular spacings of 1200. This ensures that the vertex of the deflecting cone 30 is always precisely centered on the axis of the blasting nozzle 14. The bars 36 can have a triangular or lens-shaped cross section and form a type of cutting edge on the inner side, so that they do not form an appreciable obstacle to the emerging blasting means.

The opposite ends of the bars 36 are let into corresponding longitudinal grooves in the outer surfaces of the blasting nozzle 14 and of the deflecting cone 30, and fastened by welding or in another way. This produces a configuration of the probe 18 which is particularly small overall and is also suitable for cleaning pipes 20 of narrow cross section.

Figure 2:
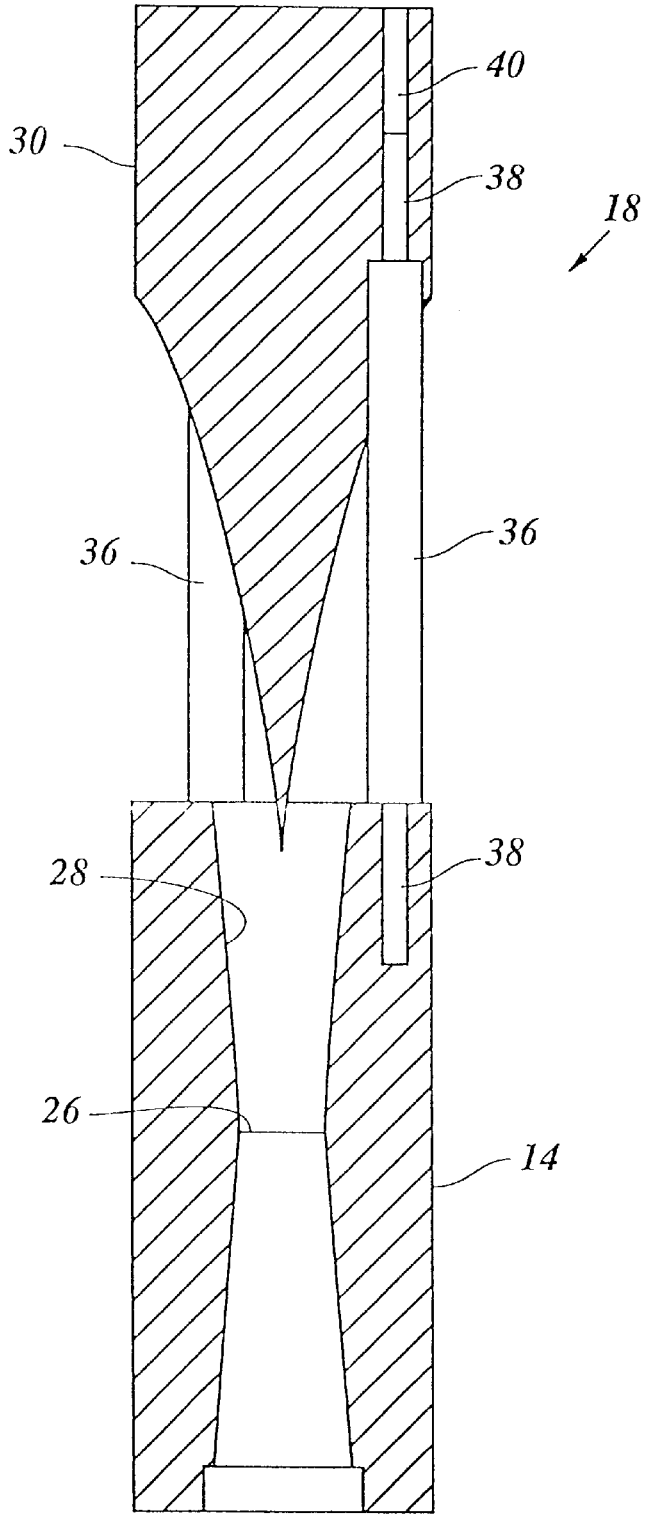
FIG. 2 shows a diagrammatic longitudinal section through a blasting device in accordance with a modified exemplary embodiment.

FIG. 2 shows an embodiment of the blasting head 18 which is suitable for pipes of larger cross section, or also for blasting freely accessible surfaces. The vertex of the deflecting cone 30 here projects somewhat into the mouth of the blasting nozzle 14. The downstream section 28 of the blasting nozzle is expanded somewhat more strongly towards the mouth than in the case of the exemplary embodiment according to FIG. 1, with the result that the cross-sectional ratio between the free exit surface at the mouth and the cross-sectional surface at the constriction 26 is again approximately 2:1.

The bars 36 are constructed here as round bars which engage with, thinner end sections 38 in corresponding axial bores 40 of the deflecting cone 30 and of the blasting nozzle 14. The end sections 38 and the bores 40 can be provided with right-hand and left-hand threads so that the bars can be screwed to the blasting nozzle and the deflecting cone. The bores 40 of the deflecting cone 30 are expanded in steps at the end facing the blasting nozzle 14, and hold the thicker middle section of the round bars 36, thus producing a cleaner connection of the round bars to the deflecting surface of the cone.

In the example shown, the thicker middle sections of the round bars 36 abut the end face of the blasting nozzle 14 obtusely, with the result that a defined spacing is maintained between the blasting nozzle and the deflecting cone 30. However, it is also optionally possible for the arrangement to be made such that the round bars also engage in expanded bores in the blasting nozzle 14. In this case, the axial spacing between the deflecting cone 30 and the blasting nozzle 14 can vary steplessly within certain limits, making it possible to optimize the jet characteristic.

Figure 3:
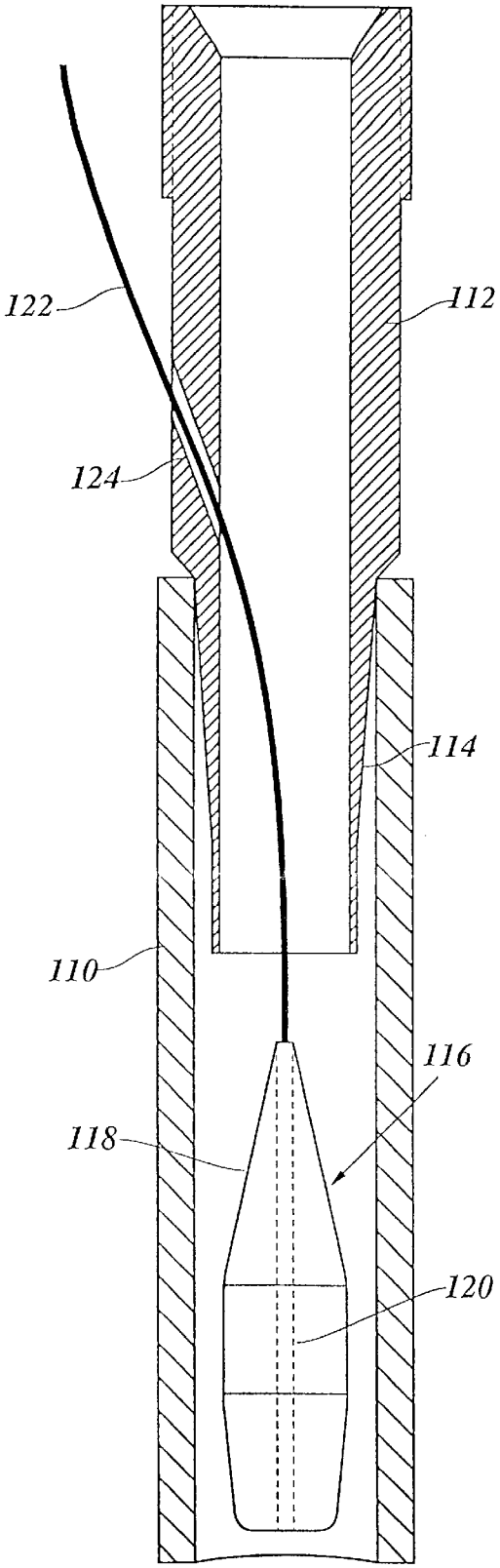
FIG. 3 shows an axial section through a blasting device in accordance with a further exemplary embodiment.

The blasting device shown in FIG. 3 is used to clean the inner surfaces of a pipe 110 with the aid of a solid or liquid blasting medium with or without blasting means.

A nozzle 112 in the form of an adapter which can be coupled to the pipe end is used to introduce the blasting medium into the pipe under high pressure. In the example shown, the nozzle 112 simply has at its front end an outer cone 114 which engages in the pipe end and bears tightly against the inner wall of the pipe when the nozzle is held by hand with a light pressure against the pipe end. A pressure hose (not shown) can be coupled to the opposite end of the nozzle, and is used to feed the blasting medium.

Also belonging to the blasting device is a deflecting member 116 constructed separately from the nozzle 112. In the example shown, the deflecting member 116 has an elongated shape resembling a ship and having a conically constructed upstream end 118. The cross-sectional shape of the deflecting member 116 is adapted to the cross-sectional shape of the pipe 110, and is therefore circular in the case of round pipes. The outside diameter of the deflecting member is somewhat smaller than the inside diameter of the pipe 110.

Fastened in an axial bore 120 of the deflecting member 116 is a draw-rope 122 which runs through the pipe 110 and through the mouth of the nozzle 112, and emerges from the nozzle 112 outside the pipe 110 through an oblique lateral opening 124. The free end of the draw-rope 122 is held by hand, wound off from a winding device (not shown), or slackened in steps with the aid of a lever-operated self-retaining locking mechanism such as is known, for example, from cartridges for pressing out pasty compounds.

The blasting medium dispensed by the nozzle 112 flows at high velocity through the pipe 110 and strikes the conical end 118 of the deflecting member 116, and is thereby deflected radially outwards, with the result that it strikes the pipe wall obliquely and cleans the inner surface of the pipe. A blasting means with a moderately abrasive effect, for example dry ice, can be added to the blasting medium. To feed the blasting means, the nozzle 112 can be provided with openings corresponding to the opening 124. Other additives can also be fed to the blasting medium through these openings, for example in order to treat the pipe wall chemically or to "coat" it to repel lime or dirt.

The blasting means is deflected by the deflecting member 116 just like the blasting medium, the result being intensive cleaning of the pipe wall. It has emerged that because of the fluid-dynamic effects, the particles of the blasting means hardly strike the surface of the deflecting member, but are deflected with the flow such that they strike the pipe wall directly. The blasting medium and the blasting means, as well as the material possibly removed from the pipe wall pass through the annular interspace between the deflecting member and the pipe wall and are removed via the pipe end opposite the nozzle 112.

If the draw-rope 122 is gradually slackened, the deflecting member 116 moves in a self-centered fashion through the pipe, with the result that the pipe 10 can gradually be cleaned over the entire length.

Figure 4:
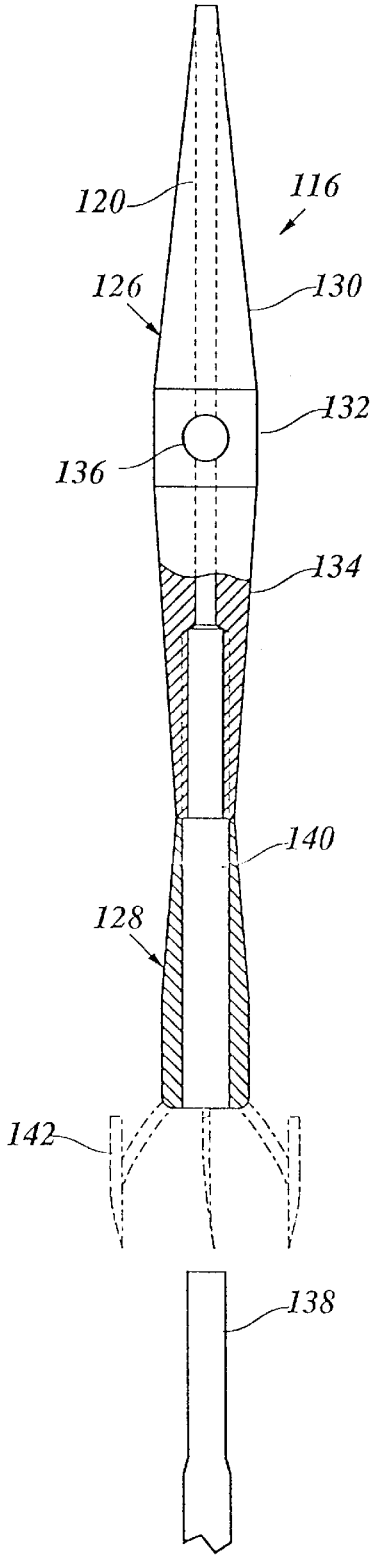
FIG. 4 shows a partially broken-open side view of the essential element of a blasting device in accordance with another exemplary embodiment.

FIG. 4 shows an exemplary embodiment of the deflecting member 116, which is suitable for even smaller pipe diameters.

The deflecting member according to FIG. 4 has a ship-shaped upstream part 126 and a conical downstream part 128 constructed as a separate component. The two parts 126, 128 can be screwed to one another or fastened on one another in another way. The upstream part has a conically expanding section 130, a shorter cylindrical section 132 and a conically tapering section 134 which follow one another in the prescribed sequence in the direction of flow. Together with the cylindrical pipe wall, the part 126 forms an annular nozzle whose cross section firstly tapers, as in the case of a Laval nozzle, and then expands again. It is possible in this way to achieve a very high flow velocity, possibly an ultrasonic velocity, downstream of the part 126 by means of the Laval effect. The conical part 128 forms the actual deflecting member, which then directs the blasting medium and the particles of the blasting means onto the pipe wall at high speed. However, the blasting medium can also already be directed for the first time onto the pipe wall by the section 130.

The deflecting member 116 according to FIG. 4 has the axial bore 120 and has, moreover, in its cylindrical section 132 a transverse bore 136 which is provided with an internal thread, and which permits the draw-rope 122 to be fixed using a grub screw.

If a strongly abrasive blasting means is used, the draw-rope can be damaged and tear. In this case, it is expedient to delay the movement of the deflecting member 116 with the aid of a rod 138 which is inserted into the pipe 110 from the opposite end and guided by hand or machine. The section 134 and the conical part 128 of the deflecting member have an axial bore 140 with a larger diameter, into which the rod 138 can be inserted or screwed.

Finally, the deflecting member 116 can also have a friction member or scraper 142, which is illustrated in FIG. 4 by dots and dashes. The scraper 142 bears with its blades, preferably under elastic pretensioning, against the inner wall of the pipe, and thus produces a braking effect which delays the movement of the deflecting member 116. Thus, it is possible, if appropriate, to dispense with the rod 138 or the draw-rope 122. At the same time, the scraper 142 loosens contaminants adhering to the pipe wall. In the example shown, the scraper 142 serves the purpose of preliminary cleaning and loosens the contaminants before they are completely removed by the jet deflected by the deflecting member. It is also possible, however, as an option or in addition to provide a towed scraper on the deflecting member for the purpose of subsequently cleaning the blasted surface. The blades of the scraper 142 can be given a slight helical setting so that, as it moves through the pipe, the deflecting member rotates about its longitudinal axis.

Figure 5:
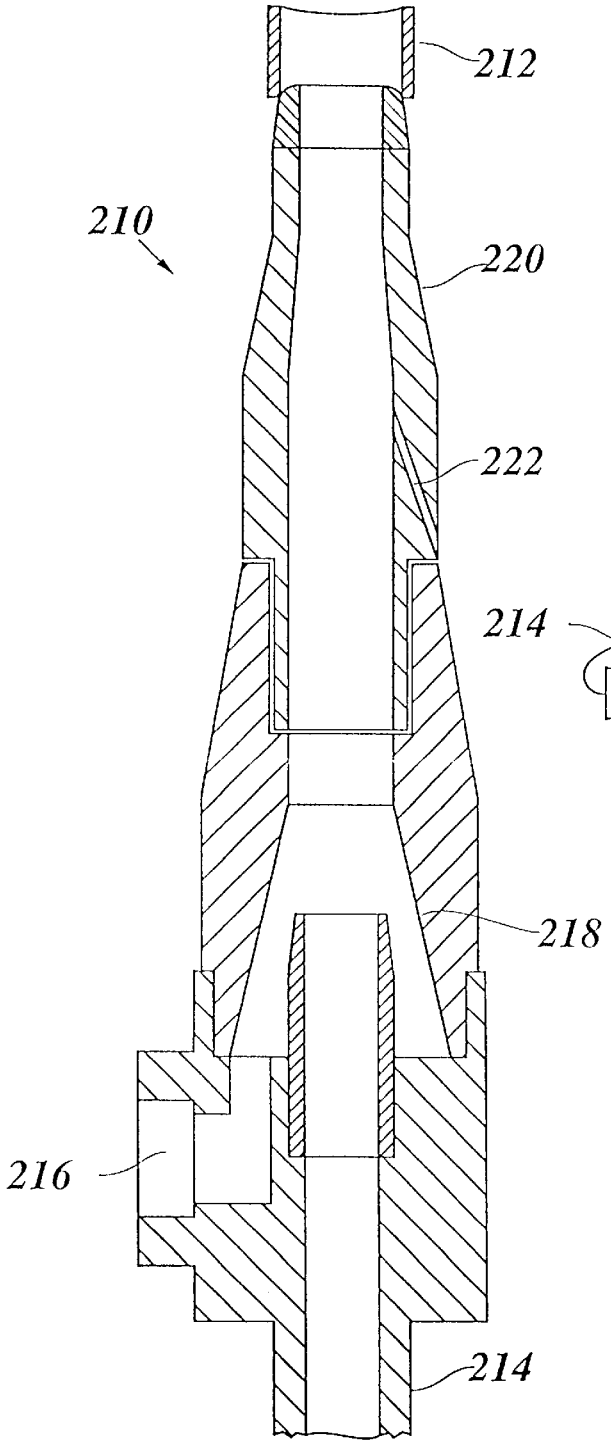
FIG. 5 shows a diagrammatic longitudinal section through a section of a blasting nozzle with a feed line for an additional blasting means.

FIG. 5 shows a blasting nozzle 210 which is placed with its tip against one end of a pipe 212 to be cleaned, and to which there is fed via a line 214 a gaseous blasting medium (air) to which dry ice has already been added. The blasting nozzle is used to introduce the blasting medium and the blasting means into the pipe 212. Since a nozzle action is not mandatory in this case, the blasting nozzle is more accurately also denoted as a blasting adapter. An additional blasting means, for example crystal sugar, is fed via an inlet 216 provided on the side of the blasting nozzle. The feed is preferably performed with the support of compressed air, but can also be performed by simply using the jet pump principle on the basis of the underpressure produced in a conical part 218 of the blasting nozzle. A side channel 222 opening obliquely into the main channel is constructed in a head part 220 of the blasting nozzle which adjoins downstream.

Figure 6:
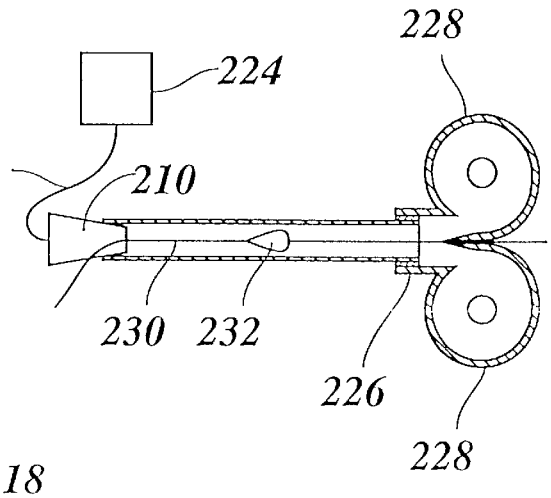
FIG. 6 shows a sketch of the principle of a blasting device in accordance with a further exemplary embodiment.

Shown diagrammatically in FIG. 6 is a dry ice feeding device 224 which is connected via the line 214 to the blasting nozzle 210 placed against one end of the pipe 212. Connected to the opposite pipe end is an end piece 226 which is connected in the example shown to two suction fans 228.

A draw-rope 230 enters the pipe 212 through the side channel 222 of the blasting nozzle 210 and emerges again at the a opposite end of the pipe through an opening in the end piece 226. A deflecting member 232 can be pulled through the pipe 212 in the longitudinal direction with the aid of this draw-rope.

The two suction fans 228, working in parallel, have a substantially higher delivery capacity than can be produced using conventional compressors or vaporizers, and therefore permit a high flow velocity to be maintained in the interior of the pipe even in the case of pipes 212 of relatively large diameter. The ambient air is inducted via the nozzle 210 and dry ice is added to it in the dry ice feeding device 224. The additional blasting means can be added optionally via the inlet 216. Inside the pipe 212, the air on the deflecting member 222, to which blasting means have been added, is accelerated again and deflected onto the pipe wall, thus producing an intensive cleaning action. The end piece 226 contains an eliminating device or a filter for the material removed and, if appropriate, the solid additional blasting means. The eliminating device, for example in the form of a cyclone, can also be integrated into the suction fan 228.

What is claimed is:

1. A blasting method for cleaning pipes with the aid of a blasting medium, comprising the steps of:

blowing a deflecting member (116; 232), around which the blasting medium is caused to flow, through a pipe (110; 212) with the aid of the blasting medium; and braking a movement of the deflecting member with the aid of a draw-rope (122, 230) from an upstream end of the pipe or with the aid of a rod (138) from a downstream end of the pipe.

2. The method according to claim 1, wherein:

said blasting medium is a gaseous blasting medium; and dry ice is added as blasting means to the gaseous blasting medium.

3. A blasting method for cleaning pipes with the aid of a gaseous blasting medium, comprising the steps of:

interconnecting a blasting nozzle and a deflecting member by means of at least three axial bars distributed over a circumference of the blasting nozzle and the deflecting member, said blasting nozzle tapering continuously to a constriction (26) in an upstream section (22) and expanding again continuously downstream starting from the constriction;

delivering the gaseous blasting medium from said blasting nozzle;

flowing the gaseous blasting medium around the deflecting member;

moving the blasting nozzle (14) and the deflecting member (30) through a pipe (20); and adding dry ice as blasting means to the gaseous blasting medium.

4. The method according to claim 1 further comprising the step of:

adding a further blasting means comprised of sugar.

5. The method according to claim 1 further comprising the step of:

inducting the blasting medium at one end of the pipe (212).

6. Blasting device for blasting an inner surfaces of pipes (110), comprising a nozzle (112) which is aligned coaxially with a pipe and delivers a blasting medium, and a deflecting member (116) which has an expanding section (130) at an upstream end and a tapering section (134) further downstream and directs the blasting medium onto a wall of the pipe, characterized in that the deflecting member (116) is movable through the pipe alone, relative to the nozzle, and in that the tapering section (134) is adjoined downstream by a part (128) which expands in a direction of flow.

7. Device according to claim 6, characterized in that the nozzle (112) is constructed as an adapter, which can be coupled to an end of the pipe for introducing the blasting medium into the pipe.

8. Device according to claim 6, characterized in that the deflecting member (116) has a friction member (142) which is in frictional contact with the wall of the pipe (10).

9. The method according to claim 1 further comprising the step of:

adding a further blasting means comprised of a chemical agent.

* * * * *